United States Patent [19]

Bidney

[11] 4,179,091

[45] Dec. 18, 1979

[54] VERTICALLY ADJUSTABLE DRAPERY ROD SUPPORT

[76] Inventor: Roger Bidney, 3997 N. Victoria St., Saint Paul, Minn. 55112

[21] Appl. No.: 803,844

[22] Filed: Jun. 6, 1977

[51] Int. Cl.[2] ..... A47H 1/10

[52] U.S. Cl. ..... 248/265; 248/295 R

[58] Field of Search ..... 248/256–265, 248/269–272, 287, 295, 298, 307, 244, 245

[56] References Cited

U.S. PATENT DOCUMENTS

| | | | |
|---|---|---|---|
| 446,675 | 2/1891 | Glidden | 248/271 |
| 627,891 | 6/1899 | Bagley et al. | 248/271 |
| 651,611 | 6/1900 | Reid | 248/271 |
| 702,537 | 6/1902 | Burley | 248/270 |
| 929,010 | 7/1909 | Provencher | 248/259 |
| 930,818 | 8/1909 | Westhauer | 248/272 |
| 1,092,424 | 4/1914 | Bobring | 248/259 |
| 1,356,237 | 10/1920 | Szefczyk | 248/271 |
| 2,056,874 | 10/1936 | Updegraff | 248/265 |
| 2,651,489 | 9/1953 | Bell | 248/269 X |
| 3,241,684 | 3/1966 | Willsey | 248/265 X |
| 3,430,908 | 3/1969 | Kowalczyk | 248/258 X |
| 4,120,474 | 10/1978 | Hurley | 248/263 |

FOREIGN PATENT DOCUMENTS

| | | | |
|---|---|---|---|
| 2234237 | 1/1974 | Fed. Rep. of Germany | 248/287 |

*Primary Examiner*—Lawrence J. Staab

*Attorney, Agent, or Firm*—Peterson, Palmatier, Sturm & Sjoquist, Ltd.

[57] ABSTRACT

The drapery rod support comprises a mounting plate which includes a central web and a pair of laterally spaced, vertically extending ribs projecting from the front side thereof, the web having a slot between the ribs extending parallel to the ribs. A pair of flange members are welded to the rear side of the web and project laterally therefrom, the flanges forming a groove therebetween with the projecting portion of each flange having a mounting hole therein. A block is positioned between the ribs, the block having a hole extending therethrough for the accommodation of a screw, a rectangular nut on the threaded end of the screw residing in the groove formed by the flange members on the rear side of the plate. The block can be retained at various preferred elevations by tightening the screw. In one embodiment, a conventional angled drapery bracket, the bracket having a forwardly extending arm, is threadedly attached to the block so as to be vertically adjustable by means of the block. In a second embodiment, what functions as the forwardly extending arm on a conventional drapery bracket is welded directly to the block so as to be vertically adjustable by means of the block.

5 Claims, 12 Drawing Figures

Fig 3
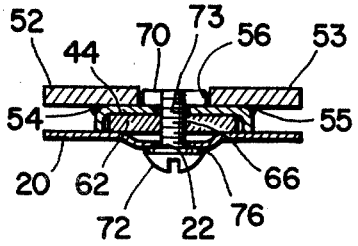
Fig 1
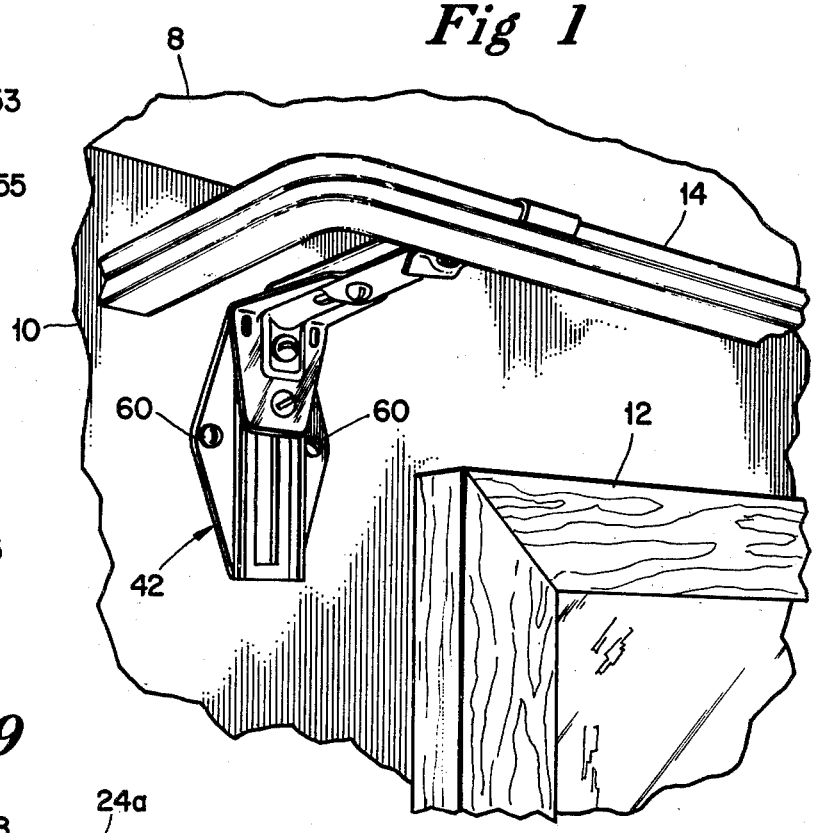
Fig 4
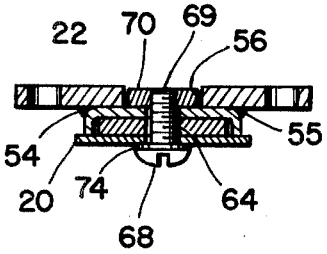
Fig 9
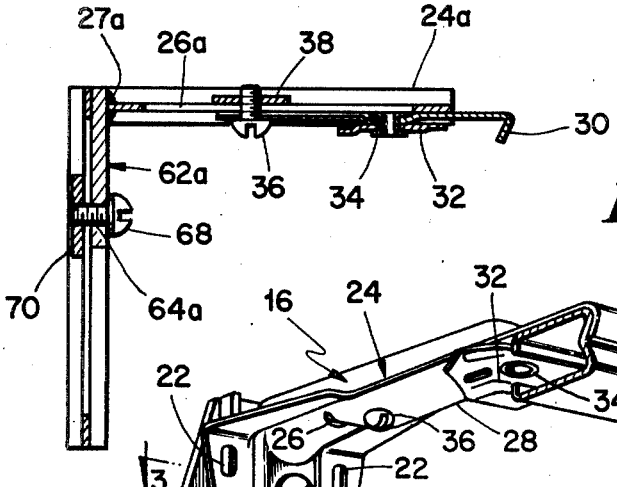
Fig 2
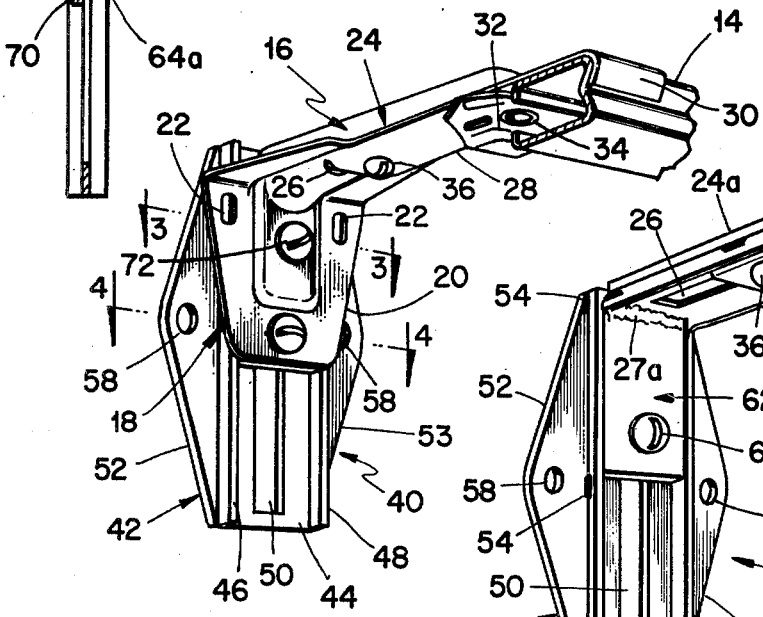
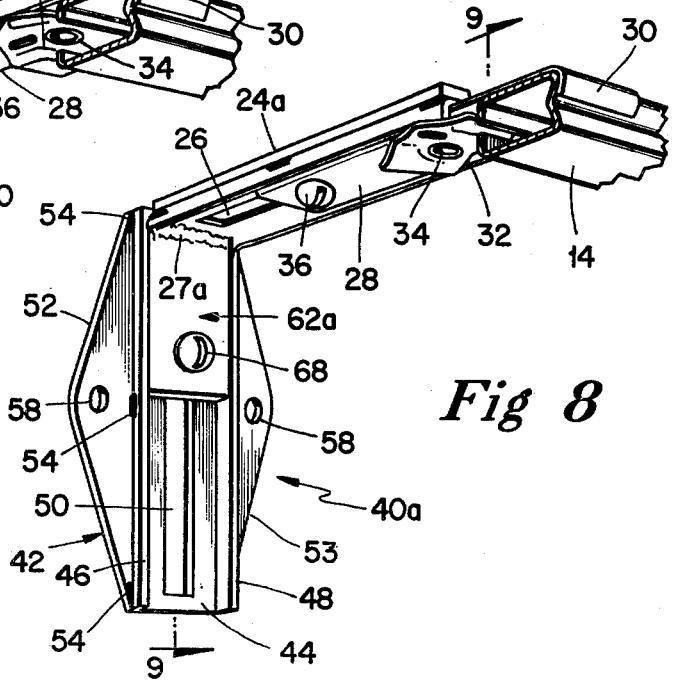
Fig 8

Fig 7
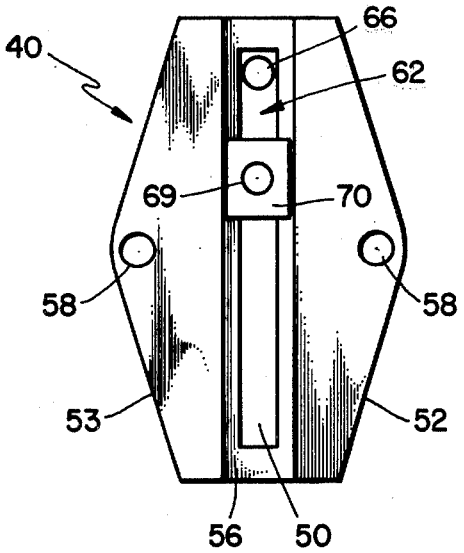
Fig 5
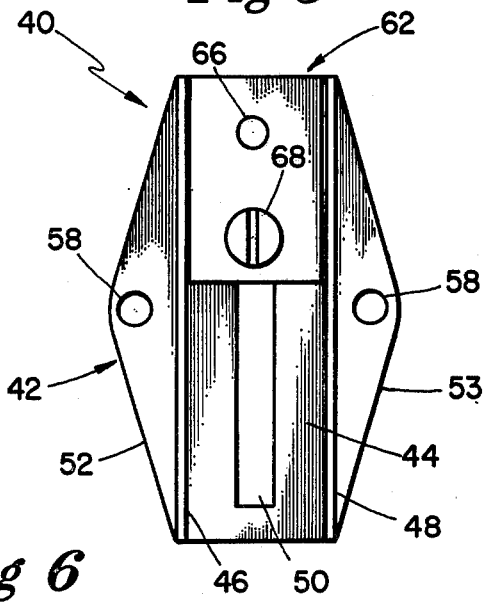
Fig 6
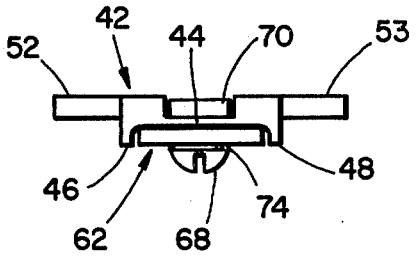
Fig 10
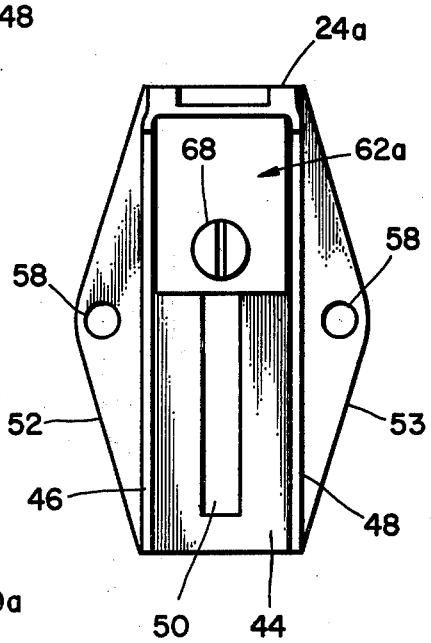
Fig 12
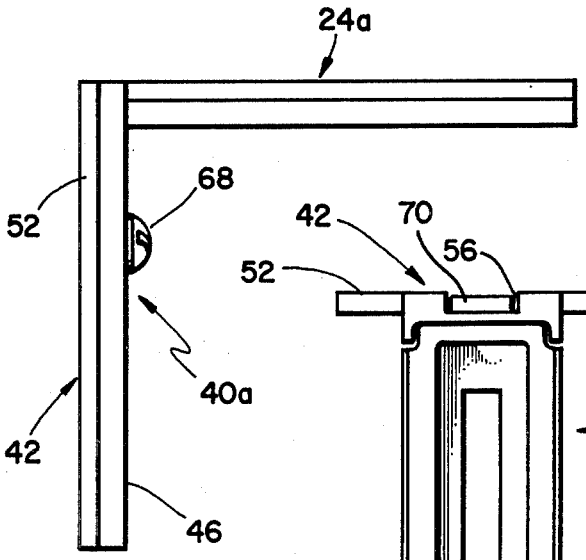
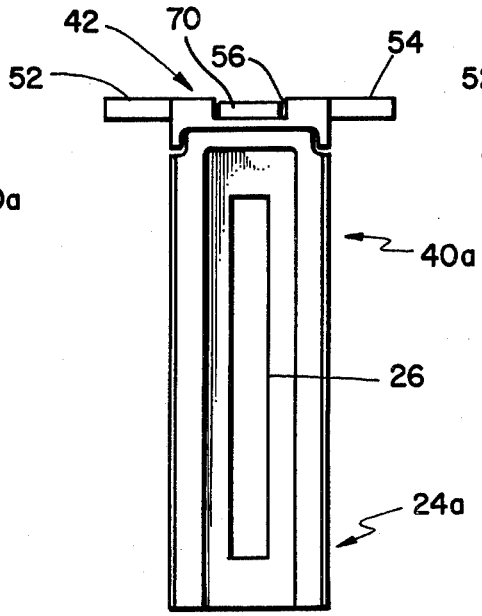
Fig 11

VERTICALLY ADJUSTABLE DRAPERY ROD SUPPORT

BACKGROUND OF THE INVENTION

1. Field of the Invention

This invention relates to vertically adjustable drapery rod supports, and pertains more particularly to a support of this type having greater versatility than heretofore.

2. Description of the Prior Art

Drapery rod supports that can be vertically adjustable are not new. However, the one with which I am best acquainted is unduly complex and costly. Such a drapery rod support is illustrated in U.S. Pat. No. 3,241,684 issued Mar. 22, 1966 to Harry W. Willsey. While the vertical adjustment at the ends of the drapery rod, as far as the patented construction is concerned, is fairly easily achieved, the hardware for realizing the adjustment is far more complicated than it should be. Although a somewhat simpler type of vertical adjustment is provided for the center support, the center support cannot be used with conventional supporting brackets. In addition to other shortcomings, the design of the center support requires more metal than it should.

SUMMARY OF THE INVENTION

Accordingly, a general object of my invention is to provide a vertically adjustable drapery rod support that can be manufactured for use with various types of conventional drapery brackets, rendering such brackets vertically adjustable, or it can be designed with part of such brackets incorporated therein.

Another object is to provide a drapery rod support that is readily adjustable over a considerable vertical distance, thereby permitting the mounting plate to be attached to the wall at only a very approximate elevation in order to effect an optimum general height of the drapery rod. In this regard, the invention takes into consideration that inexpensive draperies may shrink when cleaned, or on the other hand new draperies substituted for old ones, and in such situations not only is the original adjustment readily achieved, but any subsequent adjustment can likewise be easily made. Subsequent vertical adjustments of drapery rods are also at times necessary when the carpeting, for example, beneath the draperies is replaced, various types of carpeting differing in thickness resulting in the need for raising or lowering the bottom of the draperies with respect to the surface of the new carpeting just as easily as with respect to the old carpeting. By the same token, there may be no carpeting when the draperies are first hung and carpeting later installed, and conversely carpeting may be laid initially but later taken out completely. My invention provides for an easy adjustment irrespective of whatever changes mentioned above take place.

Another object of the invention is to provide a drapery rod support that will accommodate virtually any type of conventional drapery bracket now on the market, thereby enabling an otherwise fixed-type bracket to be vertically adjusted. In this regard, it is an aim of my invention to either permit the conventional drapery hardware to be attached to my support without modification thereof or at most by drilling one or two holes therein. Stated somewhat differently, my invention functions very well as an adapter block for conventional brackets.

A further object is to provide the vertical adjustment in the same manner realized when employing the adapter block for conventional drapery hardware mentioned in the preceding object, yet simplifying the overall construction by utilizing a horizontal arm that is integral with the vertically adjustable block.

Yet another object is to provide a drapery rod support that is vertically adjustable and which can be mounted at substantially the same height as the drapery rod itself. In other words, it is not necessary to have any portion of my vertically adjustable drapery rod support extend upwardly past the mounting plate as is required in certain prior art constructions. Also, an aim of the invention is to permit the facile removal or complete taking off of the vertically adjustable block supporting the horizontally extending arm, even though the mounting plate is mounted to the wall at a location very close to the ceiling.

Still further, an object of the invention is to provide a vertically adjustable drapery rod support that is quite rugged and which can sustain relatively heavy loads. When used to support a conventional drapery rod bracket, it imparts added rigidity to the bracket which is usually of lightweight sheet metal. Where the bracket arm is integral with the vertically positionable block, rigidity can be achieved without resorting to a complicated structural arrangement.

Briefly, my invention envisions a mounting plate that is attached to the wall by means of two screws and at only a general elevation representative of the height where the drapery rod itself should be located. The mounting plate includes a web having forwardly projecting, laterally spaced ribs with a slot centrally disposed therebetween. A block is received between the ribs and has a hole therein for the accommodation of a screw. The rear side of the mounting. plate has a groove formed by laterally projecting flanges containing the mounting holes, the mounting flanges being spaced to form the groove. In one form of the invention, a conventional drapery bracket is threadedly attached to the vertically positionable block. In a second form of the invention, the arm of a conventional drapery bracket is made integral with the vertically positionable block.

BRIEF DESCRIPTION OF THE DRAWINGS

FIG. 1 is a fragmentary perspective view of a ceiling and wall having a corner of a window therein, one of my vertically adjustable drapery rod supports being fastened to the wall and to which a conventional drapery rod bracket is attached;

FIG. 2 is an enlarged perspective view of the drapery rod support pictured in FIG. 1 with the conventional drapery rod bracket still attached;

FIG. 3 is a sectional view taken in the direction of line 3—3 of FIG. 2 for the purpose of better illustrating the manner in which the conventional drapery rod bracket is attached to my support;

FIG. 4 is a sectional view taken in the direction of line 4—4 of FIG. 2;

FIG. 5 is a front elevational view of the support of FIGS. 1-4 showing a mounting plate and vertically adjustable block;

FIG. 6 is a top view corresponding to FIG. 5;

FIG. 7 is a rear view corresponding to FIG. 5;

FIG. 8 is a perspective view corresponding to FIG. 2 but showing a somewhat different embodiment that my invention can assume;

FIG. 9 is a sectional view taken in the direction of line 9—9 of FIG. 8;

FIG. 10 is a front elevational view of the modified support appearing in FIGS. 8 and 9, the conventional bracket arm being omitted;

FIG. 11 is a top plan view corresponding to FIG. 10, and

FIG. 12 is a side elevational view corresponding to FIG. 10.

DESCRIPTION OF THE PREFERRED EMBODIMENTS

Referring first to FIG. 1, it will be observed that a portion of a ceiling 8 and a wall 10 have been depicted, the wall 10 having a corner of a typical window 12 therein. Extending across the window 12 is a conventional drapery rod 14, only a portion of the rod having been illustrated.

In one embodiment of FIG. 1 and the enlarged view thereof in FIG. 2, a conventional bracket assembly 16 has been illustrated. Although the bracket assembly 16 will vary somewhat from manufacturer to manufacturer, it will be appreciated from the ensuing description that my invention lends itself readily to accommodating various designs of brackets. The bracket assembly 16 includes an angle unit 18 comprised of a mounting panel 20 having four mounting holes 22 therein (two being visible in FIGS. 1 and 2, a third in FIG. 3 and the fourth in FIG. 4, the latter two actually being utilized) and an integral angle arm 24 projecting forwardly and horizontally from the upper edge of the mounting panel 20, the arm 24 having a slot 26 formed therein. The arm 24 supports an adjustable extension arm 28 having an integral retention lip 30 that extends over and into engagement with the drapery rod 14. A latch finger 32 is pivotally mounted on a tubular rivet 34 so as to cam the drapery rod 14 tightly against the retention lip 30. A screw 36 extends upwardly through a slot 26, a nut (not visible) on the screw 36 serving to hold the extension arm 28 in an adjusted relation with respect to the wall 10.

My vertically adjustable drapery rod support has been denoted generally by the reference numeral 40. The support 40 comprises a mounting plate 42 which includes a web 44 having laterally spaced, vertically extending ribs 46, 48 thereon which project forwardly from the front side of the web 44. The ribs 46, 48 are parallel with respect to each other and a slot 50 extends vertically in a parallel relationship with the two ribs 46, 48.

Flange members 52 and 53 are welded to the rear side of the web 44 at locations 54 and 55, respectively (FIGS. 3 and 4). Actually, there are several vertically spaced locations 54, 55 at which welds are made. However, if desired, the welds can extend the full length of the flange members 52 and 53. The flange members 52 and 53 are spaced apart so as to form a rear groove 56 therebetween. The laterally projecting portions of the flange members 52 and 53 each have a mounting hole 58 therein. Mounting screws 60 extend through the holes 58 into the wall 10, thereby anchoring the mounting plate 42 at the approximate height desired for the drapery rod 14.

At this time, attention is directed to an adapter block 62. This block 62 is in the form of a rectangular metal strip. It contains an untapped hole 64 and tapped hole 66. A screw 68 having a threaded shank 69 extends through the untapped hole 64. A square nut 70 is threadedly attached to the shank 69, the square nut 70 having a width corresponding to the width of the groove 56. Thus, the square nut 70 cannot rotate when the screw 68 is tightened. A screw 72 having a threaded shank 73 extends into the tapped hole 66. If desired, a washer 74 can be placed between the head of the screw 68 and the mounting panel 20, and similarly a washer 76 can be placed between the head of the screw 72 and the panel 20.

Having presented the foregoing description, the advantages to be gained from employing my vertically adjustable drapery rod support 40 should be readily apparent. However, in order to assure a full understanding of the benefits to be derived, it can be explained that the conventional bracket assembly 16, as already pointed out, can vary from manufacturer to manufacturer, and is attached to the adapter block 62 by means of the screws 68 and 72.

Whereas the threaded shank 69 of the screw 68 extends through the untapped hole 64 into the square nut 70, the shank 73 of the screw 72 extends into the tapped hole 66. The screw 68 need not be tightened fully at this particular stage. However, the screw 72 can be fully tightened at this point. It should be mentioned that if the mounting panel 20 does not have appropriately located holes, such as the holes 22 visible in FIGS. 3 and 4, for the accommodation of the screws 68 and 72, appropriately located holes can readily be drilled.

With the screws 68 and 72 in place as explained above, then the mounting plate 42 is ready to be anchored to the wall 10. To do this, the conventional bracket assembly 16, namely its mounting panel 20, is shifted upwardly sufficiently so as to make accessible the holes 58 in the flange members 52 and 53. The mounting screws 60 are then advanced into the wall 10 at approximately the general height at which the drapery rod 14 is to be held. Owing to the relatively large vertical adjustment possible when practicing my invention, the location need only be generally correct.

With the screws 60 anchored to the wall 10, and the screw 68 sufficiently loose so that the adapter block 62 is free to be moved vertically, the block 62 is either raised or lowered, as the case may be, to the proper height for the drapery rod 14. When the desired height is reached, the screw 68 is tightened. The square nut 70, it will be appreciated, cannot turn or twist because it is contained in the groove 56 and any tendency to rotate is resisted by the flange members 52 and 53 forming the groove 56.

It should be noted that the adapter block 62 is on the front side of the mounting plate 42. Hence, it can be quite short. Actually, its length need only be sufficient to permit the forming of the two holes 64 and 66, yet a considerable amount of vertical adjustment is permitted by reason of the length of the web 44, more particularly the length of the slot 50 formed therein. Also, it should be recognized that even with the mounting plate 52 at such a height that it virtually abuts the ceiling, the adapter block 62 still can be adjusted upwardly to such a height that the arm 24 is virtually touching the ceiling. This is a decided advantage over the prior art.

To illustrate the versatility of my invention, attention is now directed to the embodiment pictured in FIGS. 8–12. The modified vertically adjustable drapery rod support has been given the reference numeral 40*a*. It includes the mounting plate 42 of the preceding embodiment 40. Thus, there is no change made to the mounting plate 42 so the various elements constituting this plate have been given the same reference numerals.

Actually, the block 62a is quite similar to the block 62. However, it has only the untapped hole 64a. Corresponding in function to the angle arm 24 of the conventional bracket assembly 16 is a horizontal arm 24a having a central slot 26a therein, the arm 24a being welded at 27a directly to the upper end of the block 62a. The arm 24a supports an extension arm which is identical to the extension arm 28 illustrated with the support 40, so the same reference numeral has been used. Also, the extension arm 28 has the same retention lip 30, the same latch finger 32, the same tubular rivet 34 and the screw 36, together with the nut 38 (visible in FIG. 9, but concealed in FIGS. 1 and 2 that depict the support 40), the screw 36 and nut 38 holding the arm 24 at the proper location on the arm 24a.

The manner in which the mounting plate 42 of the support 40a is attached or anchored to the wall 10 is the same as with the support 40. Likewise, a screw 68 extends through the untapped holes 64a into engagement with a square nut 70. Consequently, the way in which the vertical adjustment is realized is the same as with the earlier-described embodiment 40.

I claim:

1. A vertically adjustable rod support comprising a mounting plate including a central web and a pair of laterally spaced ribs extending vertically throughout the length of said central web and projecting perpendicularly from the front side thereof, said web having a slot extending vertically throughout substantially the length of said central web between said ribs and parallel thereto, and a pair of flat flange members secured to the rear side of said web, each having a portion projecting laterally therefrom, said flange members being spaced from each other to form a vertical groove therebetween extending the length of said central web and the laterally projecting portion of each flange member having a mounting hole therein, and a rectangular block between said ribs, said block having upper and lower edges and a hole extending therethrough, a screw having a threaded shank extending through both said block hole and said vertical slot, a retention nut in said groove received on said shank, and arm means connected at one end to said block adjacent the upper edge thereof and projecting perpendicularly from said block for engaging a drapery rod at the other or free end thereof, the upper end of said vertical slot and the hole in said block being relatively located with respect to each other so that the upper edge of said block and said arm means can be adjusted to a height corresponding to the upper end of said central web, whereby said screw, when tightened, maintains said block and said arm means at selected vertically adjusted positions including a position in which said arm means is at said corresponding height.

2. A drapery rod support in accordance with claim 1 in which said block has a threaded hole for connecting said one end of said arm means thereto.

3. A drapery rod support in accordance with claim 1 in which said one end of said arm means is integral with said block.

4. A drapery rod support in accordance with claim 1 in which said retention nut is square to prevent its rotation in said groove.

5. A drapery rod support in accordance with claim 1 in which said flange members are secured to the rear side of said web by welding.

* * * * *